United States Patent [19]

Langenfeld et al.

[11] Patent Number: 4,787,811

[45] Date of Patent: Nov. 29, 1988

[54] QUICK ATTACH MEANS FOR ATTACHMENTS

[75] Inventors: Joseph W. Langenfeld; Neal W. Westendorf, both of Onawa, Iowa

[73] Assignee: Westendorf Mfg. Co., Inc., Onawa, Iowa

[21] Appl. No.: 525,134

[22] Filed: Aug. 22, 1983

[51] Int. Cl.[4] ..... E02F 3/81

[52] U.S. Cl. ..... 414/723; 172/872

[58] Field of Search ..... 414/722, 723; 37/117.5, 37/118 A, 118 R; 172/272-275

[56] References Cited

U.S. PATENT DOCUMENTS

| | | | |
|---|---|---|---|
| 3,760,883 | 9/1973 | Birk | 414/723 |
| 3,794,195 | 2/1974 | Clevenger et al. | 414/723 |
| 3,985,249 | 10/1976 | Aker et al. | 414/723 |
| 4,119,225 | 10/1978 | Macht et al. | 414/723 |
| 4,253,793 | 3/1981 | Braml | 414/723 |
| 4,452,560 | 6/1984 | Coyle et al. | 414/723 |

*Primary Examiner*—Leslie J. Paperner
*Assistant Examiner*—P. McCoy Smith
*Attorney, Agent, or Firm*—Zarley, McKee, Thomte Voorhees & Sease

[57] ABSTRACT

A quick attach means for a tractor loader is described comprising a pair of arcuate brackets pivotally secured to the forward ends of the loader boom arms. Each of the brackets has upper and lower horizontally extending pipes secured thereto which are adapted to be received by pockets at the rearward side of the loader bucket. A locking assembly is provided on the bracket for maintaining the pipes in their respective pockets.

2 Claims, 6 Drawing Sheets

QUICK ATTACH MEANS FOR ATTACHMENTS

BACKGROUND OF THE INVENTION

Conventional end loaders such as tractor loaders or the like usually have a pair of booms pivotally secured at their rearward ends to the tractor and pivotally secured at their forward ends to the attachment by means of a pin extending through spaced-apart ears on the attachment and through the boom. The hydraulic cylinders are also usually pivotally connected to the rearward end of the attachment by means of pins substantially similar to the maner in which the booms are pivotally secured to the attachment. Thus, when it is desired to remove a particular attachment from the loader, it is necessary to remove four pins and to subsequently replace the pins in another attachment. It is difficult and time consuming in attempting to position the four pins for insertion in their respective openings and the hook-up difficulty is further increased due to the fact that the piston rods of the hydraulic cylinders are sometimes difficult to align since one rod may tend to extend farther than the rod on the other hydraulic cylinder. The connection and the disconnection of the various attachments are also difficult when the attachment is not on exactly level ground.

A quick attach apparatus was previously disclosed in U.S. Pat. No. 3,512,665. Still another quick attach apparatus was previously disclosed in U.S. Pat. No. 4,085,856. The instant invention represents a significant improvement over the prior art devices in that great strength is achieved.

Therefore, it is a principal object of this invention to provide a quick attach means for end loaders such as tractor loaders or the like.

A further object of the invention is to provide a quick attach means for tractor loaders which permits utilization of a loader bucket having a curved rear wall.

A further object of the invention is to provide a quick attach means for tractor loaders which is extremely easy to manipulate.

These and other objects will be apparent to those skilled in the art.

SUMMARY OF THE INVENTION

Figure 1:
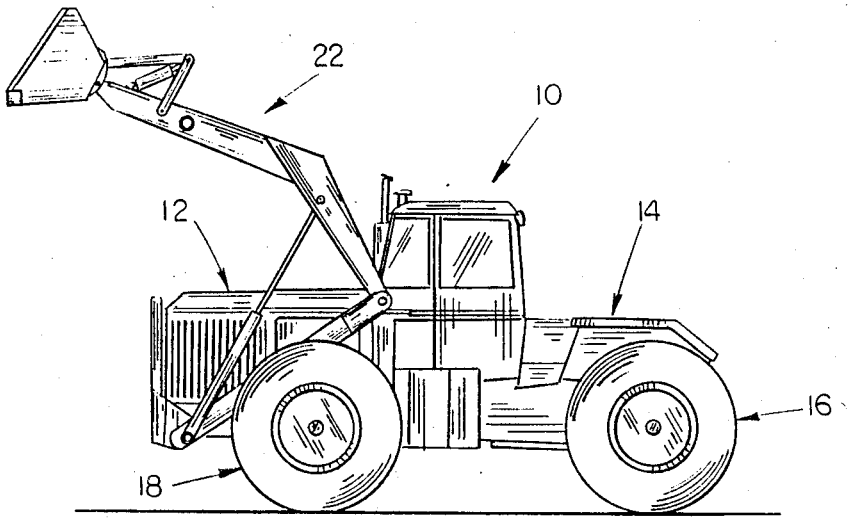
FIG. 1 is a side view of a tractor having the loader mounted thereon.
Figure 2:
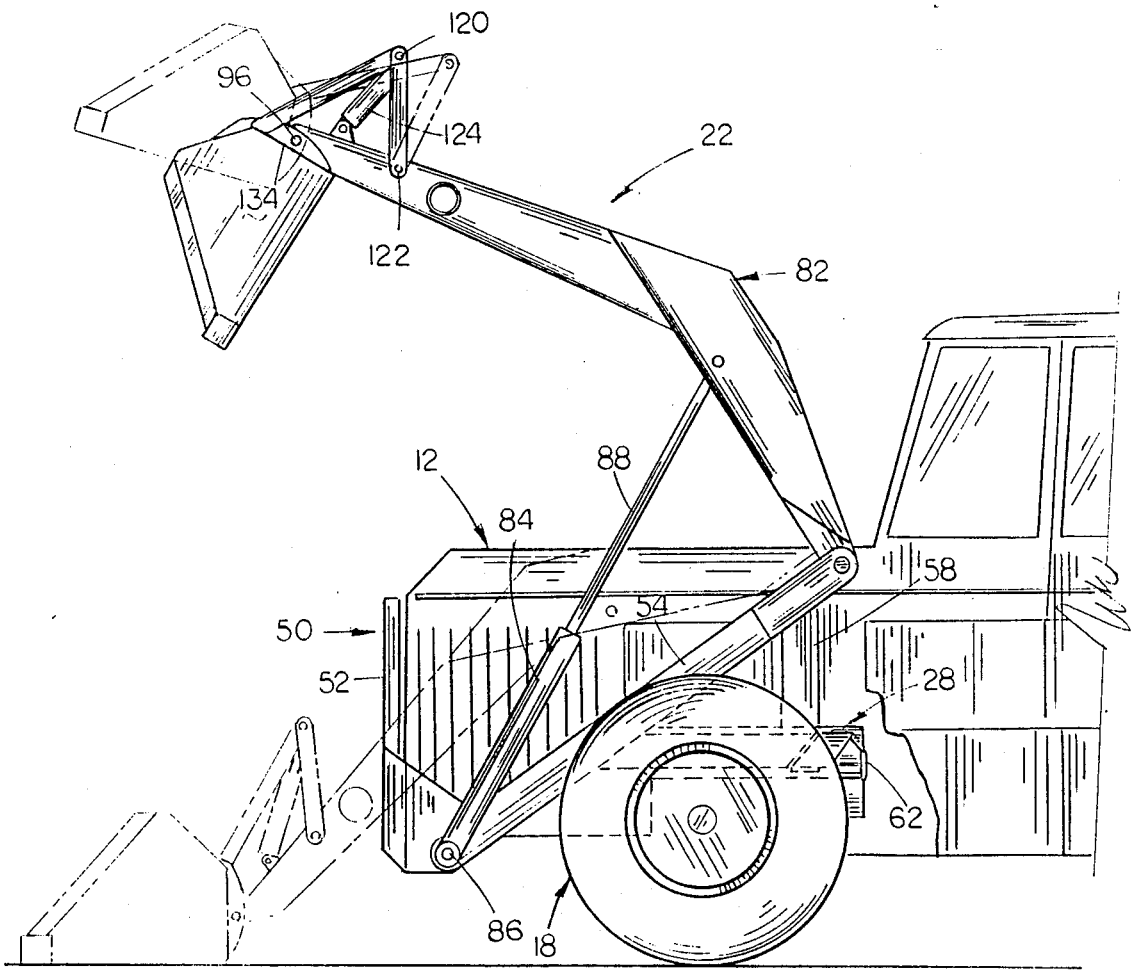
FIG. 2 is a view similar to FIG. 1 illustrating the various positions to which the loader and bucket may be moved.
Figure 4:
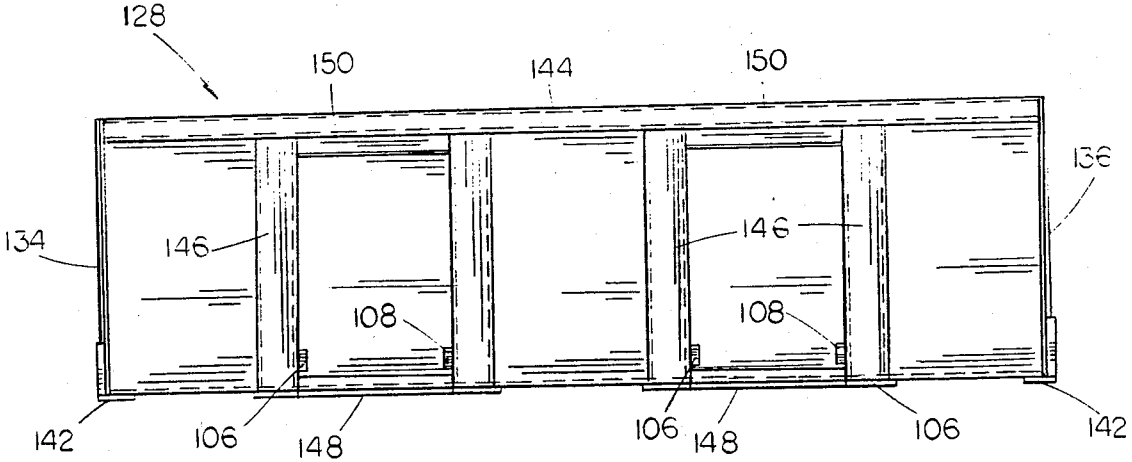
FIG. 4 is a rear elevational view of the loader bucket.

A quick attach means for tractor loaders is described comprising a pair of arcuate brackets pivotally secured to the forward ends of a pair of boom arms. Each of the brackets has a horizontally extending pipe secured to the upper end thereof and a horizontally extending pipe secured to the lower end thereof. The upper pipe is received with a pocket at the rear end of the loader as is the lower pipe. Pivotal locking levers are mounted on opposite of the bracket to maintain the pipes in their respective pockets. A hydraulic cylinder-operated linkage is connected to the brackets to permit the brackets to be pivotally moved with respect to the boom arms.

DESCRIPTION OF THE PREFERRED EMBODIMENT

The numeral 10 refers to a four-wheel tractor of the articulated type comprising a front articulated section 12 and a rear articulated section 14. Tractor 10 is provided with a pair of rear wheels 16 and a pair of front wheels 18.

Figure 10:
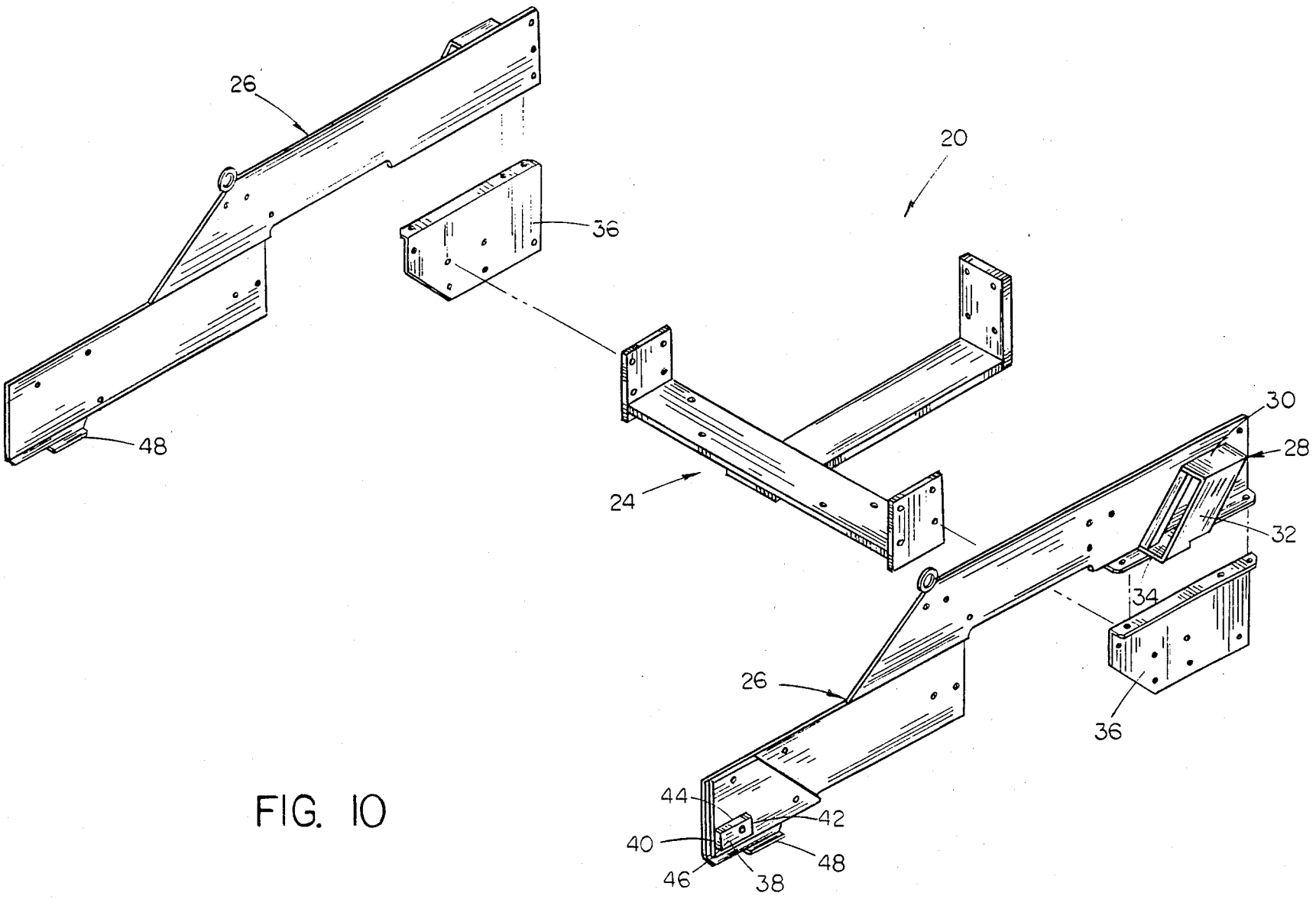
FIG. 10 is a perspective view of the supporting frame for the loader which is mounted on the tractor.

FIG. 10 illustrates a supporting frame and which is refered to by the reference numeral 20. Supporting frame 20 forms a portion of the loader 22 and is designed to support the loader 22 on the tractor.

Supporting frame 20 comprises a center frame portion 24 which is bolted to the underside and sides of the front articulated portion 12. Side supporting frames 26 and 26' are bolted to opposite sides of the tractor and are mirror images of each other. Inasmuch as side supporting frames 26 and 26' are identical, only side supporting frame 26 will be described in detail.

The numeral 28 refers to a connector element or pocket which is secured to the exterior surface of the rearward end of the frame 26. Pocket 28 includes an upper wall 30, outer 32, and lower wall 34. As seen in the drawings, the forward and rearward ends of the pocket 28 are open and that the rearward end of bottom wall 34 is spaced forwardly of the rearward end of top wall 30. Frame 24 is secured to frames 26 and 26' by brackets 36 and 36' respectively.

A rectangular block 38 is secured to the forward end of frame 26 by welding or the like and extends outwardly therefrom as illustrated in FIG. 10. For purposes of description, block 32 will be described as having a forward end 40, rearward end 42, top portion 44 and bottom portion 46. As seen in FIG. 10, bracket 48 extends laterally outwardly from the lower end of frame 26 below block 38.

Figure 9:
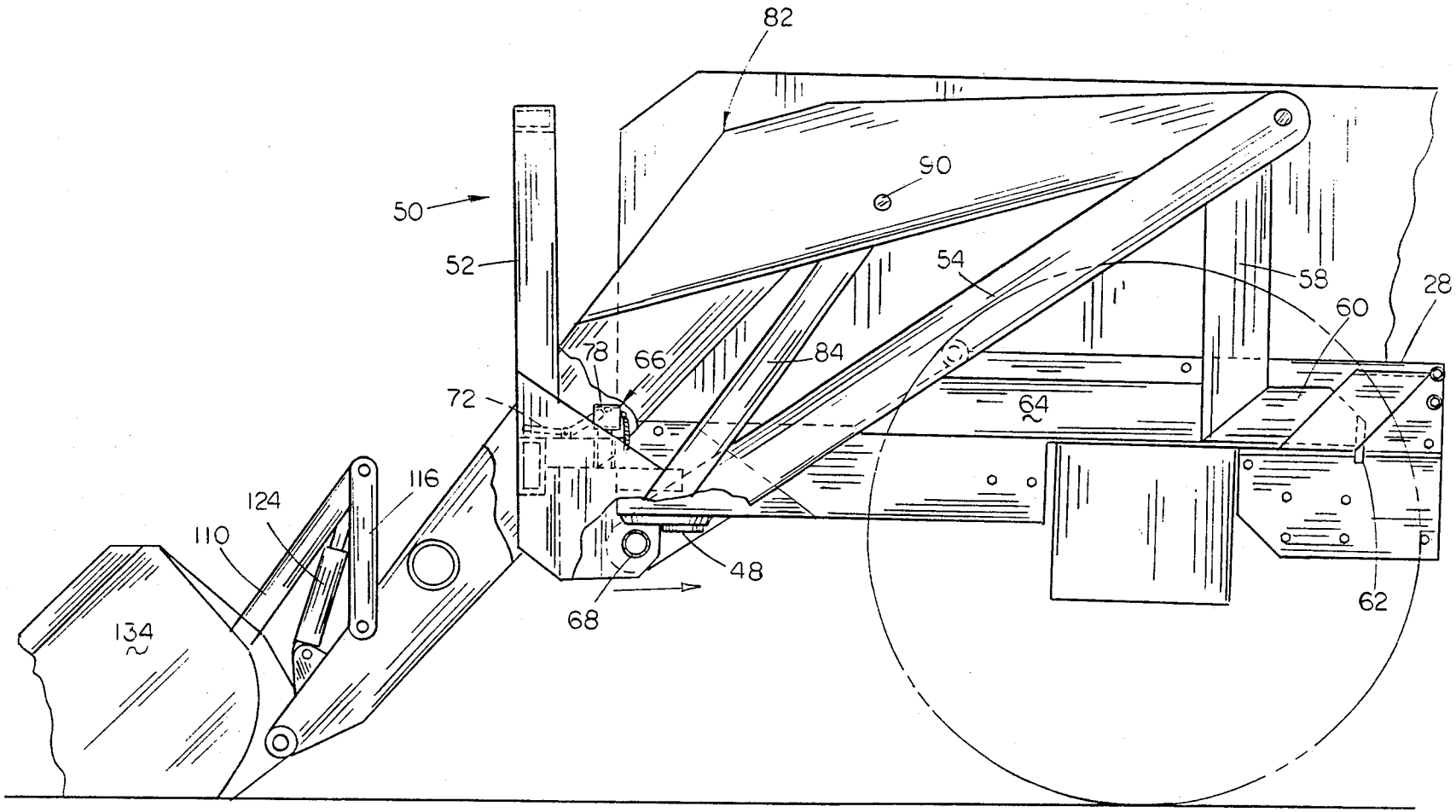
FIG. 9 is a view similar to FIG. 7 except that the loader has been mounted on the tractor.

Loader 22 includes a substantially U-shaped frame means 50 which is adapted to be removably secured to the supporting frame 20 on the tractor 10. Frame means 50 includes a front frame 52 having a pair of side frames 54 and 56 (not shown) extending upwardly and rearwardly from the opposite lower sides thereof. Side frame 56 is identical to side frame 54. Frame member is secured to and extends downwardly from the rearward end of side frame 54 and includes a rearwardly extending portion 60 as best illustrated in FIG. 9. Finger 62 extends downwardly from the lower rearward end of rearwardly extending portion 60. Frame member 64 is secured to and extends between frame members 54 and 58 as seen in FIG. 9 for strengthening purposes.

A pair of locking or connector 66 and 66' (not shown) are secured to the inside surfaces of front frame 52 at opposite sides thereof. Pipe or shaft 86 extends horizontally between the opposite sides of front frame 52 at the lower end thereof and is designed to engage the underside of the brackets 48 and 48' as will be described in more detail hereinafter.

Figure 7:
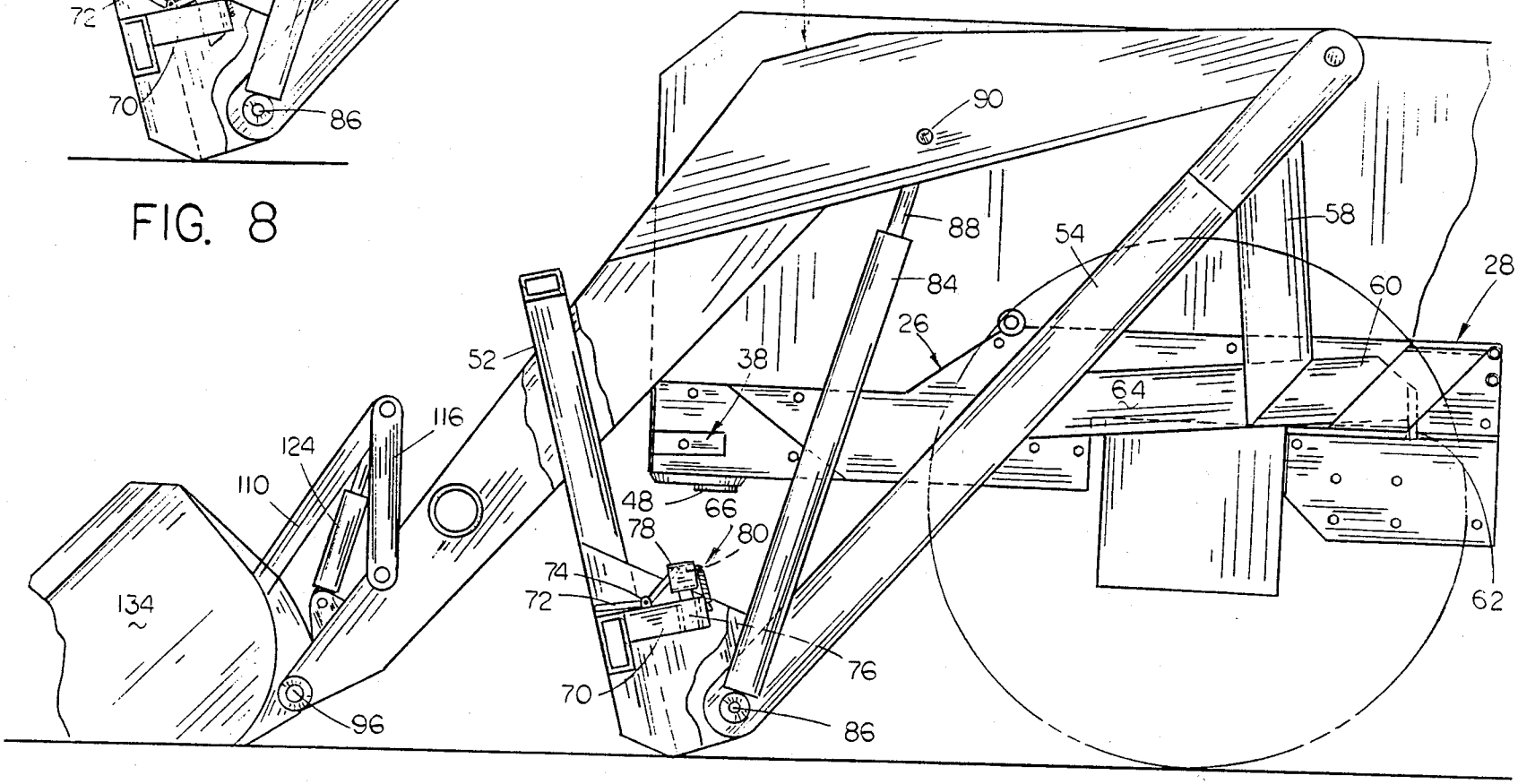
FIG. 7 is a side view illustrating the loader being mounted on the tractor with portions thereof cut away to fully illustrate the invention.
Figure 8:
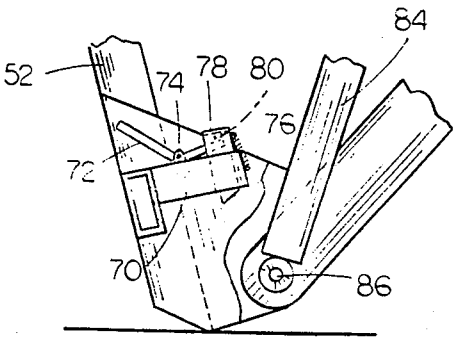
FIG. 8 is a side elevational view illustrating the locking mechanism in its locked position.

Each of the locking elements 66 comprises a rectangular channel member 70 having a locking lever 72 pivotally mounted thereon at 74. A spring-loaded pin 76 is vertically moveably received in the rearward end of the channel 70 and has a hollow channel member 78 mounted at the upper end thereof. As seen in FIG. 8 of the drawings, the rearward end of lever 72 is received within the forward end of the channel member 78 and is designed to raise the pin or plunger 76 at times so that the lower end thereof does not protude below the lower end of channel 70. A small lip 80 is provided in the upper interior of channel member 78 which is adapted to yieldably engage the rearward end of lever 72 to provide a means for maintaining the pin 76 in the unlocked position of FIG. 7. When the forward end of lever 72 is moved upwardly, the plunger or pin 76 moves downwardly from the lower end of channel member 70.

A pair of boom arms 82 and 82' are pivotally connected at their upper rearward ends to the frame members 54 and 56 respectively. A hydraulic cylinder 84 is secured at its base end to the outer end of pipe 86 and extends upwardly therefrom. Likewise, a cylinder 84' (not shown) extends between frame member 56 and boom arm 82'. The rod 88 of cylinder 84 is connected to the boom arm 82 at 90. Quick-attach assemblies 92 and 92' are pivotally secured to the forward ends of boom arms 82 and 82' respectively. Inasmuch as assemblies 92 and 92' are identical, only assembly 92 will be described in detail.

Assembly 92 comprises an arcuate bracket 94 pivotally connected to the forward end of boom arm 82 by means of pin 96. An elongated pipe 98 is secured to the upper end of bracket 94 and an elongated pipe 100 is secured to the lower end of bracket 94. Plates 102 and 104 are pivotally connected to opposite sides of bracket 94 for engagement with the lugs 106 and 108 respectively as will be described hereinafter.

Figure 6:
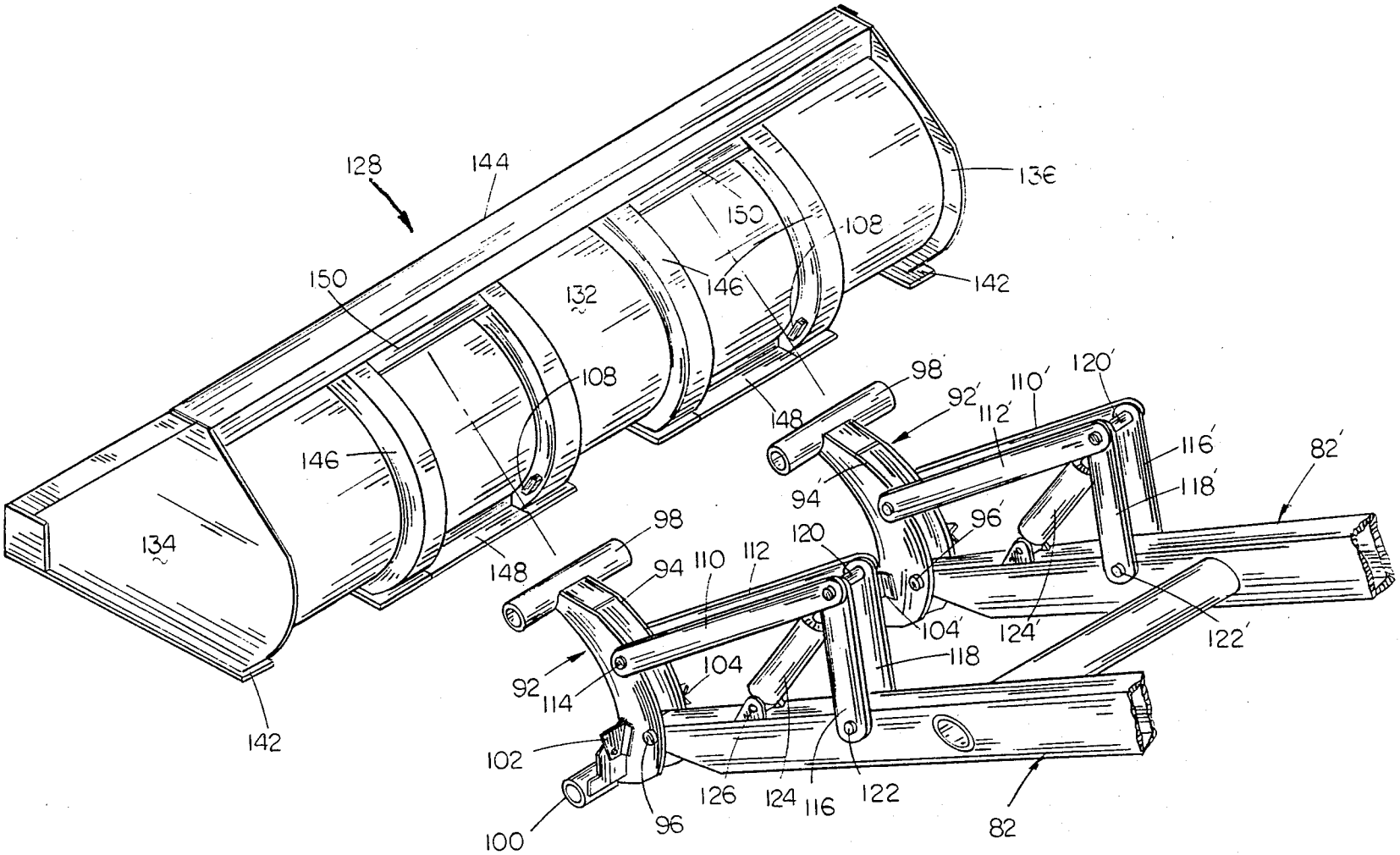
FIG. 6 is a partial rear perspective view of the loader bucket and the quick attach means.

As seen in FIG. 6, a pair of arms or links 110 and 112 are pivotally connected to bracket 94 by pin 114 and extend rearwardly therefrom. Arms or links 116 and 118 are pivotally connected to the rearward ends of arms 110 and 112 by means of pin 120. The lower ends of arms 116 and 118 are pivotally connected to the boom arm 82 by pin 122. Hydraulic cylinder 124 is pivotally connected at its base end to the boom arm 82 by pin 126 and has its rod end connected to the pin 120.

The numeral 128 refers to a materials-handling bucket including a bottom wall 130, back wall 132, and opposite side walls 134 and 136. If desired, bottom wall 130 and back wall 132 may be integrally formed. As seen in the drawings, back wall 132 includes a lower end portion 138 which extends upwardly and rearwardly from the rearward end of bottom wall 130 and an upper end portion 140 which extends upwardly and forwardly from the upper end of lower end portion 138. A hollow tube 144 is secured to the upper end of back wall 132 and extends between the side walls 134 and 136. The strength of the bucket is achieved by means of the curved tubular ribs or members 146 which are welded to the rearward side of back wall 132. The upper ends of the tubular members 146 are welded to the underside of tube 144. The lower ends of the tubes 146 are also welded to an angle member 148. As seen in the drawings, the lugs 106 and 108 are secured to the tubes 146 rearwardly of the exterior surface of back wall 132. As best seen in FIG. 6, bars 150 and 150' are secured to and extend between adjacent pairs of the tubes 146.

Figure 5:
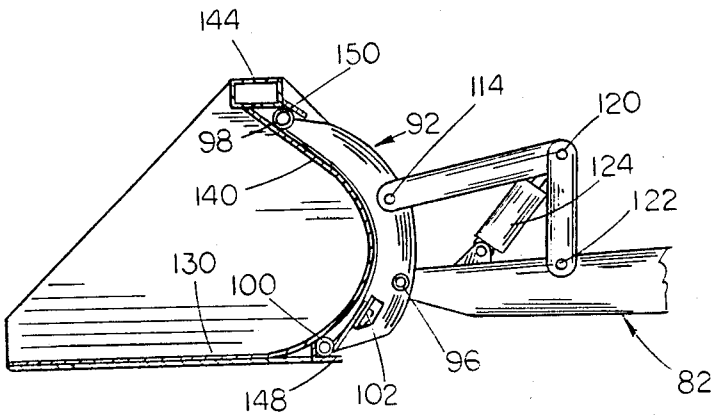
FIG. 5 is a sectional view of the bucket.
Figure 3:
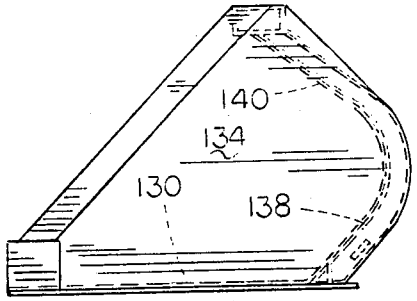
FIG. 3 is an end elevational view of the loader bucket.

Assuming that the bucket 128 is disconnected from the end loader, the normal method of operation is as follows. The tractor is manuevered so that the quick-attach assemblies 92 and 92' are positioned rearwardly of the bucket with the elongated members 98 and 98' being positioned below the plates 150 and 150'. The tractor is driven forwardly and the boom arms and quick-attach assemblies 92 and 92' are operated so that the elongated members 98 and 98' are received beneath the plates 150 and 150'. The bucket is then raised upwardly by means of the boom arms and the quick-attach assemblies 92 and 92' are pivotally moved so that the elongated members 100 and 100' are moved into the position illustrated in FIG. 5. The plates 102 and 104 on each of the quick-attach assemblies are then pivotally moved downwardly between the back wall of the bucket and the lugs 106 and 108 respectively which locks the quick-attach assembly into position.

The fact that the elongated members are received within "pockets" ensures that any stress imposed on the bucket will be distributed over a wide area and will not be focused on a particular point. The quick-attach assemblies of this invention are easily manuevered to effect the connection of the bucket to the end loader and represents a significant advance in the art.

Therefore, it can be seen that the invention accomplishes at least of its stated objectives.

I claim:

1. In combination, an end loader adapted to be mounted on a tractor and including a pair of pivotal booms, said end loader including a pair of hydraulic cylinders which are each pivotally connected at one end to one of said booms, a first hook-up bracket pivotally secured to one of said booms and operatively connected to one of said hydraulic cylinders, a second hook-up bracket pivotally secured to the other of said booms and operatively connected to the other of said hydraulic cylinder means, each of said hook-up brackets having upper and lower ends, each of said hook-up brackets being curved along their lengths, each of said hook-up brackets having a first horizontally disposed, elongated member at its upper end and a second horizontally disposed, elongated member at its lower end, a materials handling attachment having a curved rearward side with upper and lower ends, said attachment having first and second pairs of horizontally spaced, curved supports secured to the rearward side thereof, said first pair of supports comprising first and second tubes, said second pair of supports comprising third and fourth tubes, said tubes having upper and lower ends, a first support means extending between the upper ends of said first and second tubes to define a first, horizontally disposed, elongated pocket, a second support means extending between the upper ends of said third and fourth tubes to define a second horizontally disposed, elongated pocket, a third support means extending between the lower ends of said first and second tubes to define a third horizontally disposed, elongated pocket, a fourth support means extending between the lower ends of said third and fourth tubes to define a fourth horizontally disposed, elongated pocket, each of said first and second pockets having an open lower end adapted to receive one of said first elongated members therein, each of said third and fourth pockets having an open rearward end adapted to receive one of said second elongated members therein, the ends of said first and second elongated members on each of said hook-up brackets closely positioned to the associated tube to prevent relative lateral movement between said hook-up brackets and said attachment, and means for locking said second elongated members in said third and fourth pockets.

2. The combination of claim 1 wherein said means for locking said second elongated members in said third and fourth pockets comprises locking lugs on said tubes spaced rearwardly of the rearward side of said attachment, and pivotal locking plates on said brackets adapted to engage said locking lugs.

* * * * *